United States Patent [19]

Jackson

[11] 4,067,305

[45] Jan. 10, 1978

[54] CONVERTER KIT FOR DRIVING AN ENGINE DISTRIBUTOR FROM THE FRONT END OF THE ENGINE CAMSHAFT

[76] Inventor: Maurus E. Jackson, 1905 Victory Blvd., No. 9, Glendale, Calif. 91201

[21] Appl. No.: 662,552

[22] Filed: Mar. 1, 1976

[51] Int. Cl.[2] ..... F02F 7/00

[52] U.S. Cl. ..... 123/195 A; 123/DIG. 1

[58] Field of Search ..... 123/195 A, 195 R, 198 R

[56] References Cited

U.S. PATENT DOCUMENTS

| | | | |
|---|---|---|---|
| 2,731,008 | 1/1956 | Porsche | 123/195 A |
| 2,747,563 | 5/1956 | Doster | 123/195 A |
| 2,867,202 | 1/1959 | Weissenbach | 123/195 A |
| 3,338,229 | 8/1967 | Lorean | 123/195 A |
| 3,613,645 | 10/1971 | Froumajou | 123/195 A |

*Primary Examiner*—Clarence R. Gordon
*Attorney, Agent, or Firm*—Sellers and Brace

[57] ABSTRACT

A converter kit for use in converting a stock vehicle engine to drive the distributor assembly from the front rather than the rear end of the engine camshaft thereby to provide improved synchronization between the crank shaft and distributor, particularly at higher engine speeds. The kit includes a main body casting securable across the front end of the engine and having a drive connection extending through a stock camshaft cover into a drive coupling secured to the front end of the camshaft. The engine distributor is transferable directly from its original support housing into a vertically disposed receiving well of the converter casting. The support brackets for the converter casting include cooling fluid passages across the outer ends thereof adapted to be sandwiched between the stock cooling fluid pump flow passages and the engine cooling passages. The kit includes auxiliary accessories usable to drive the oil pump independently of the distributor and to drive the cooling fluid pump from a drive pulley mounted further forwardly of the engine crank shaft.

18 Claims, 8 Drawing Figures

FIG. 3.
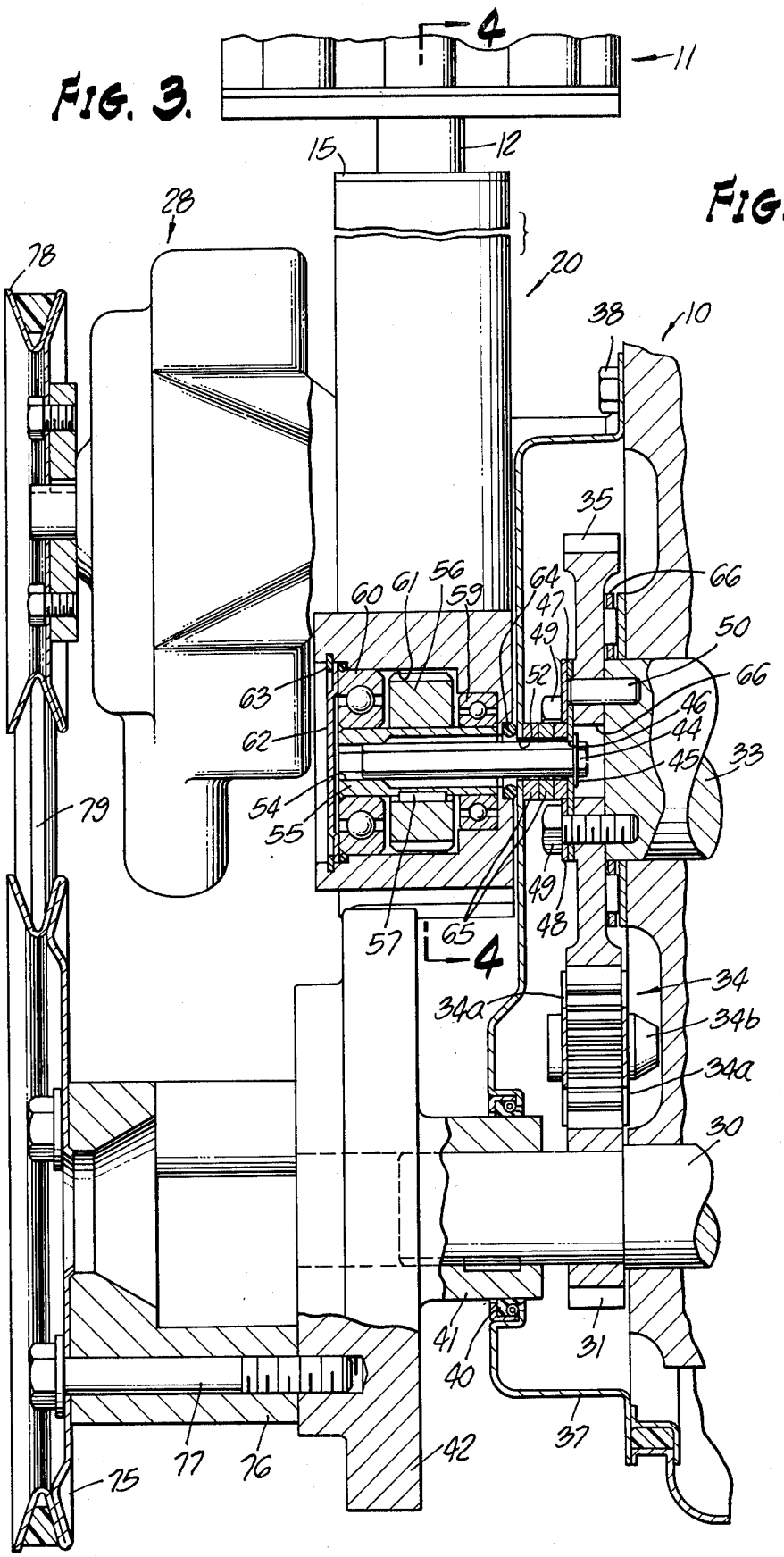
FIG. 5.
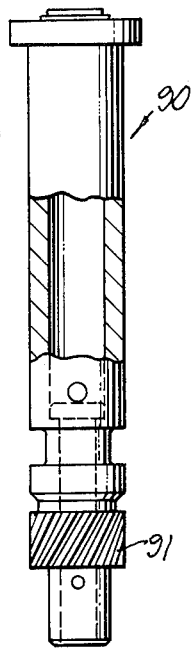
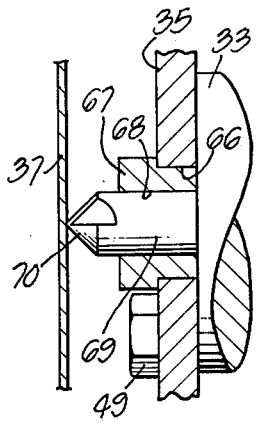
FIG. 6.

CONVERTER KIT FOR DRIVING AN ENGINE DISTRIBUTOR FROM THE FRONT END OF THE ENGINE CAMSHAFT

This invention relates to internal combustion engines and more particularly to a converter kit for very substantially improving the performance of an engine by utilizing the converter components to transfer the distributor from the rear to the front end of the camshaft and making use to a maximum of stock engine components.

Certain internal combustion engines have superior characteristics for use in auto racing but are subject to a deficiency in ignition timing attributable to certain variable characteristics of the drive connections between the engine crank shaft and the distributor. One source of these deficiencies comprises the chain drive widely used to interconnect the crank shaft and the camshaft and a second principal source occurs because of distortions taking place in the camshaft employed to drive the distributor and which increase in magnitude at higher engine speeds. The errors arising from the use of a timer chain are cured in a highly satisfactory manner by substituting one of the gear drive converter kits for the stock chain drive as disclosed in my prior U.S. Pat. Nos. 3,732,745 and 3,732,855 granted May 15, 1973. There remains however, the serious timing deficiencies arising from distortions in the camshaft in those engines driving the distributor from the rear end of the camshaft.

Engine designs have been proposed dating back many decades for driving the distributor from the front end of the camshaft or from the crank shaft. However, the use of these concepts in a modern stock engine would require major reconstruction of the engine and are totally unfeasible.

Racing enthusiasts and racing engine designers have made attempts to utilizing the modern high-performance engine by providing specially constructed accessories having as their objective the transfer of the ignition distributor to the front end of the engine. In general, these proposals utilize a complex substitute camshaft cover including a support for the distributor assembly and having facilities for connecting the camshaft to the distributor drive gear. The main casting of these converter kits are excessively heavy, bulky and costly to manufacture.

The present invention avoids the shortcomings and disadvantages of the aforementioned converter kits and has as its objective the utilization of the maximum number of stock components; greater simplicity and substantial cost savings. The errors introduced by the conventional timer chain are eliminated by utilizing the timing gear converter kit disclosed in my aforementioned patents installed generally in the manner disclosed in those patents. Thereafter the stock distributor is transferred to the front end of the engine using the kit components constituting the present invention. These comprise the main converter casting having support arms provided at their outer ends with cooling fluid passages securable to the engine block cooling passages. A non-circular drive shaft is coupled to the camshaft drive gear and extends through a new hole formed in the camshaft cover into a telescopic drive connection with the drive for the distributor mounted in the converter casting. An upwardly opening well in the converter casting is designed to receive a stock distributor with its spiral drive meshing with a spiral gear installed in the converter casting.

If forced cooling fluid circulation is desired, the stock pump is secured in place forwardly of the main converter casting and in registry with the cooling passages of the converter support bracket, the converter casting and pump being secured firmly to the engine by a common set of assembly cap screws. The drive pulley for the pump must be supported in a new outboard position and this is accomplished by a spacer component and a set of longer assembly bolts forming part of the kit. Another converter component comprises a dummy substitute shaft for the distributor which is installed in lieu of the distributor drive shaft in the housing at the rear of the engine to replace the removed distributor in providing a drive connection between the engine crankshaft and the oil pump.

Accordingly it is a primary object of the invention to provide a simple, rugged, inexpensive converter kit usable to transfer an engine distributor assembly for drive from the front rather than the rear of the engine camshaft.

Another object of the invention is the provision of a converter kit for supporting a stock distributor for drive from the front end of the engine camshaft and supported forwardly of the stock camshaft cover plate on brackets secured to the front ends of the engine block cooling passages.

Another object of the invention is the provision of an engine converter kit by which a stock distributor assembly can be driven from the front end of the camshaft by a drive connection passing through a new opening formed in a stock camshaft cover plate.

Another object of the invention is the provision of a converter kit for remounting an engine distributor at the front end of the engine in a converter casting sandwiched between the stock cooling pump and the engine block cooling passages.

Another object of the invention is the provision of a converter kit for remounting a stock distributor for drive from the front end of the engine and including a dummy drive usable in the original distributor mount in lieu of the distributor to drive the engine oil pump.

These and other more specific objects will appear upon reading the following specification and claims and upon considering in connection therewith the attached drawing to which they relate.

Referring now to the drawing in which a preferred embodiment of the invention is illustrated:

FIG. 3 is a cross-sectional view on an enlarged scale taken generally along line 3—3 on FIG. 1 and with major portions of the cooling pump shown in elevation;

FIG. 5 is a partial cross-sectional and elevational view of the dummy drive component for the engine oil pump and mountable in the stock distributor support housing when the distributor is transferred to the front of the engine;

FIG. 6 is a fragmentary cross-sectional view showing the combination drill and drill hole marker components temporarily installed at the forward end of the camshaft and in use to mark the camshaft cover plate for boring a hole to receive the converter drive shaft for the distributor;

Figure 1:
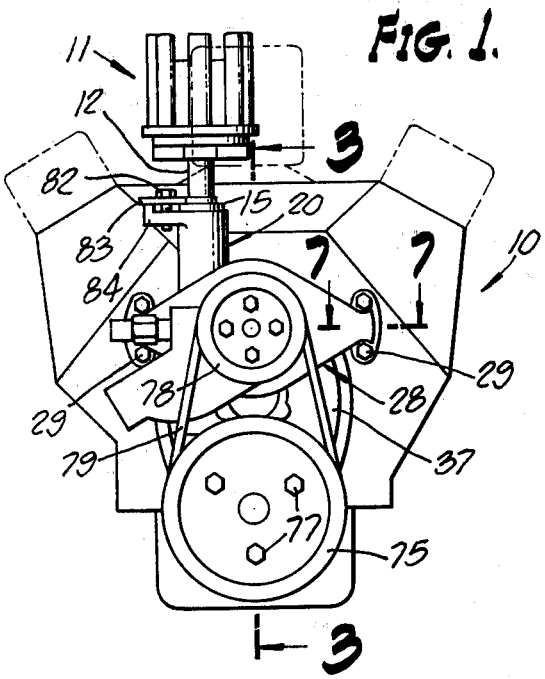
FIG. 1 is a general elevational view of the front end of an internal combustion engine having the invention converter kit installed thereon between the block and the cooling pump.
Figure 2:
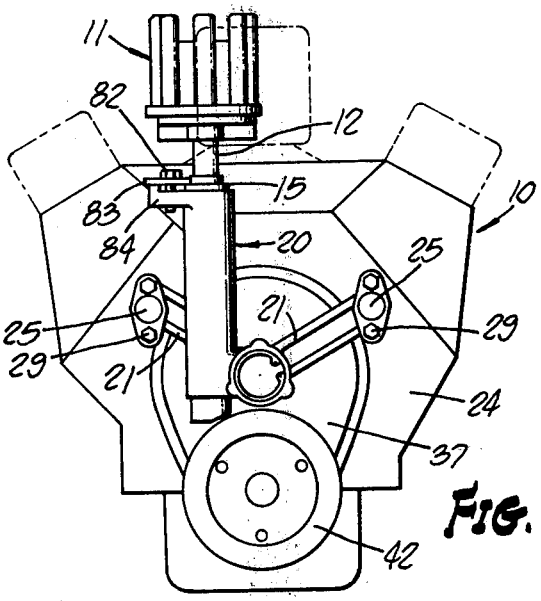
FIG. 2 is a view similar to FIG. 1 except that the cooling pump and its drive pulley and belt have been omitted as optionally unnecessary when the engine is to be used only for drag racing runs.

Referring initially more particularly to FIGS. 1 and 2 there is shown somewhat diagrammatically an eight-cylinder vehicle engine, designated 10 and, typically, that manufactured by the Chevrolet Motor Company and preferred by many racing enthusiasts. As produced by the manufacturer, this engine has a unitary distributor assembly 11 mounted in an upwardly opening housing at the rear end of the engine block. Assembly 11 has a drive shaft 12 projecting downwardly from its lower end and equipped with a spiral driven gear 13 mating with a drive gear, not shown, but driven by the engine camshaft. Gear 13 also mates with a second spiral gear, not shown, which drives the engine oil pump. A journal 14 for shaft 12 includes a flange 15 at its upper end which rests on and supports the distributor assembly 11 at the end of the aforementioned housing.

Figure 7:
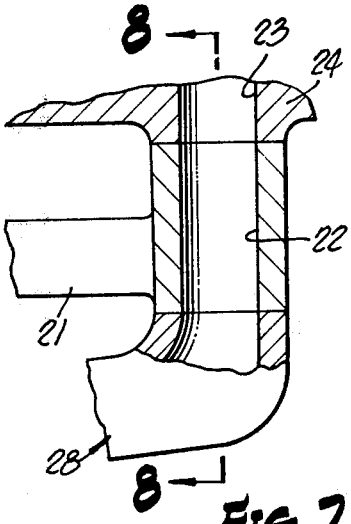
FIG. 7 is a cross-sectional view on an enlarged scale take along line 7—7 on FIG. 1.

FIG. 2 shows distributor 11 remounted at the front end of the engine without the cooling pump and provides an unobstructed view of the main body casting 20 of the converter kit. Main body 20 is generally cross-shaped mounting brackets 21,21 projecting in opposite directions from its lower end. The outer end of each of these brackets is provided with a tubular passage 22 (FIG. 7) adapted to register with a respective one of the cooling water passageways 23 of the engine block 24. If the engine is to be used without a water pump, the outer ends of passages 22 are closed by a knock-out or a thin diaphragm 25 (FIG. 2). In this event the cooling fluid does not circulate through the engine block which is acceptable practice if the racing run is of short duration as it is in drag racing. Otherwise, passages 22 are open and in communication with the inlet and outlet openings of the stock cooling pump 28. Whether the converter casting 20 is clamped to the engine block alone or with the cooling pump, a set of cap screw 29 (FIG. 1, 2 and 8) forming part of the invention kit are used to clamp these components to the engine block.

Referring to FIG. 3 there is shown a cross-sectional view through the forward end of engine 10 with the converter kit components installed with the engine distributor assembly 11 supported in the upright well 80 (FIG. 4) provided in the main body casting 20 of the converter kit. The gear train driving the distributor and the camshaft 33 comprises a gear 31 keyed to crankshaft 30 and meshing with a floating idler gear unit 34 in mesh with a camshaft gear 35. It will be understood that the floating idler gear unit 34 is preferably of the type illustrated and disclosed in my U.S. Pat. No. 3,732,855, granted May 15, 1973 to which reference may be had for the details of that construction. This gear train is enclosed by a sheet metal camshaft cover plate 37 secured to the front end face of the engine block by cap screws 38. The front end of crankshaft 30 extends through an oil seal 40 carried by this cover plate and having sealing engagement with hub 41 of a crankshaft dampener 42 keyed to the crankshaft.

Figure 4:
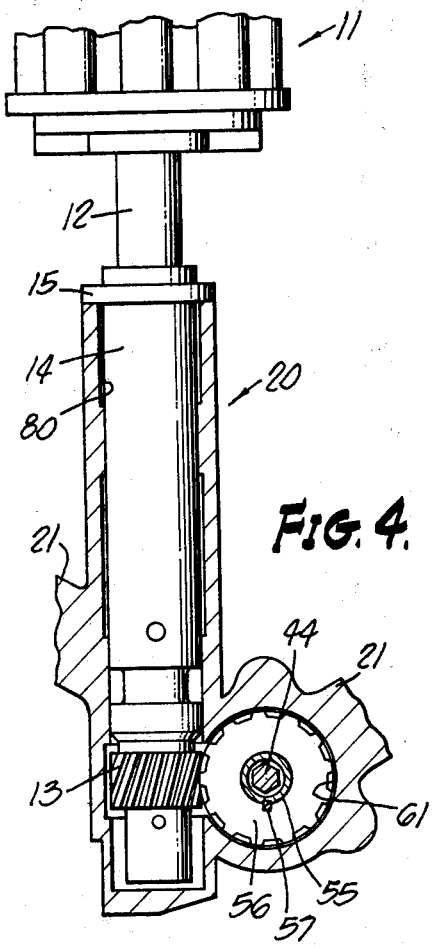
FIG. 4 is a fragmentary cross-sectional view on a reduced scale taken along line 4—4 on FIG. 3.

The coupling interconnecting camshaft 33 with the driven spiral gear 13 mounted on distributor shaft 12 will now be described with reference to FIGS. 3 and 4. This drive coupling comprises a hexagonal drive shaft 44 held captive by a split keeper ring 45 in a complementally shaped hole 46 of a plate 47. Plate 47, along with a washer 48 and timer gear 35, are held rigidly clamped to the outer end of camshaft 33 by cap screws 49. Both plate 47 and gear 35 are held accurately oriented on the end of camshaft 33 by a precision index pin 50 anchored in the end of the camshaft with its outer end extending through snugfitting holes in gear 35 and plate 47 as shown in FIG. 3.

The outboard end of the hexagonal drive shaft 44 extends outwardly through an opening 52 in the camshaft cover plate 37 and into a hexagonal bore 54 of a hollow shaft 55 supported internally of the converter casting 20. A spiral gear 56 is secured to the midlength of shaft 55 by a key 54. The opposite ends of shaft 55 are mounted in ball bearing assemblies 59,60 supported in the opposite ends of a shouldered bore 61 extending crosswise of casting 20 in the portion thereof adjacent the roots of the supporting brackets 21,21. The outboard larger end of bore 61 is closed by a cover plate 62 and a split keeper ring 63. The smaller end of bore 61 is provided with an annular groove seating an O-ring seal 64 with its outer face in sealing engagement with the outer surface of cover plate 37.

Desirably several loose-fitting spacer rings 65 are assembled about the inner end of shaft 44 and serve as a buffer or thrust bearing between the outer end of the camshaft and cover plate 37. A second thrust bearing 66 supporting radially disposed needle bearings surrounds the camshaft between gear 35 and the engine block. The camshaft may shift axially by small amounts during operation and usually to the left as viewed in FIG. 3.

A description of the remaining components of the converter kit will be made in connection with a description of the procedure for converting an engine from rear to front drive of its stock distributor.

The first step involves removal of the cooling pump 38 by detaching its assembly cap screws following removal of the camshaft cover plate 37. The timer chain normally present on a stock engine is then removed for replacement by a timer gear train such as that disclosed in my aforementioned patents. This gear train is shown in FIG. 3 and includes the crankshaft gear 31, the camshaft gear 35 and and the floating idler gear unit 34 interconnecting the two first mentioned gears. Unit 34 will be understood as including a pair of identical idler gears in mesh with gears 31 and 35 on the opposite sides of a plane passing through the axes of shafts 30 and 33. As here shown, these idler gears are interconnected by a pair of side links 34*a*,34*a* and pins 34*b* passing through the ends of these links and a center bore through the idler gears.

Initially, gear 35 is assembled to the camshaft alone and without the mounting plate 47 for stub shaft 44, thereby leaving the accurately formed central bore 66 of gear 35 open and unobstructed. This permits the smaller end of adapter collar 67 (FIG. 6) to be inserted into the snug-fitting bore 66. The central bore 68 of collar 67 is then used to seat and support the shank end of a combination marking punch and drill 69. The conical outer end 70 of marker 69 protrudes sufficiently beyond the end of camshaft 33 to serve as a punching tool to prick-punch the inner surface of the camshaft cover plate 37 as this cover plate is reassembled over the timing gear train and pressed against tip 70 of the marker. Cover 37 is then detached and the combination marker and drill bit 69 is mounted in a drill press chuck and used to drill a hole 52 through cover 37 of the proper size to accommodate the hexagonal drive shaft 44 for the distributor.

Figure 8:
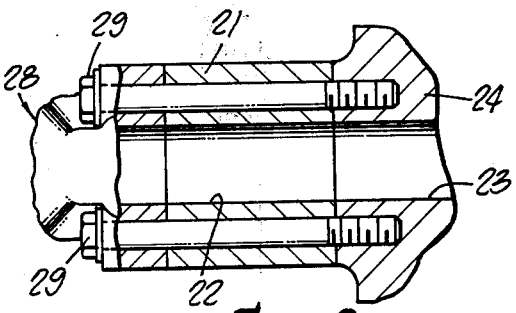
FIG. 8 is a fragmentary cross-sectional view taken along line 8—8 on FIG. 7.

The preparation of the cover plate having been completed the adapter collar 67 is removed from bore 66 of gear 35 and drive shaft 44 for the distributor and its supporting components 47,48,49 (FIG. 3) are reassembled to the camshaft with the outboard end of shaft 44 free for telescopic assembly into the complementally shaped bore 54 of hollow shaft 55. The main body 20 of the converter casting is next assembled to the front of the engine with passages 22 through the outer ends of its mounting brackets 21 registering with the cooling passage ducts 23 of the engine block. If the engine is to be used without the cooling pump, the converter casting 20 is secured in place by cap screws 29 without removing the closure plates 25 normally present across passages 22. If pump 28 is to be used, its inlet and outlet passages are registered with the outer ends of the now open passages 22 and clamped to the engine block by cap screws 29 (FIG. 8). The installation then has the appearance illustrated in FIG. 1 whereas without the cooling pump the front end of the engine appears as shown in FIG. 2.

It will be understood that passageways 22 at the outer ends of the mounting brackets 21 are sufficiently long to permit the wate pump to straddle and slightly clear the main body casting 20.

The next step is to remove the belt pulley 75 and remount it to the crankshaft dampener 42 by interposing the spacer adapter 76 between the pulley and the dampener and using the longer cap screws 77 to hold these parts firmly assembled to the dampener. Drive pulley 75 is now in alignment with pump pulley 78 and a stock V-belt 79 is used to connect pulleys 75 and 78.

Distributor assembly 11 is now unclamped and withdrawn from its operating position at the rear of the engine and inserted downwardly through the open top of well 80 (FIG. 4) of converter casting 20. When fully inserted the collar 15 at the upper end of journal 14 rests against the top rim of the well and the drive gear 13 coupled to the lower end of the distributor shaft 12 is in mesh with gear 56 coupled to the outboard end of the hexagonal shaft 44. The distributor assembly is clamped in place in its new support by a cap screw 82 extending through a radial extension 83 of collar 15 and into a threaded bore provided in an extension 84 of casting 20 in the manner best shown in FIGS. 1 and 2.

The final step in the conversion operation is to insert a dummy drive unit 90 comprising a replica of the major portion of the distributor drive shaft into the original mounting housing for the distributor at the rear of the engine. Drive unit 90 is shown in FIG. 5 and includes a suitably supported shaft for the spiral gear 91, which is a replica of distributor gear 13, and takes the place of the distributor drive gear in providing a drive connection between the engine camshaft and the drive gear of the engine lubricating pump. The dummy drive unit 90 is secured in place in any suitable manner.

The operation of the stock distributor 11 in its newly installed position will be readily understood from the detailed description of the converter and its assembly to the engine set forth above. It will be self-evident that the relocated distributor is completely isolated from any torque distortions occurring between the opposite ends of camshaft 33 under different engine operating conditions as well as isolated from lost motion variations characteristic of timer chain drives for the camshaft.

While the particular converter kit for driving an engine distributor from the front end of the engine camshaft herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. That improvement for an internal combustion engine of the type manufactured with one end of its camshaft driven from the crankshaft and its other end driving the distributor rotor, said improvement comprising: a converter kit for driving the distributor from the driven end of the camshaft to eliminate timing errors caused by torque distortion of the camshaft, said converter kit including a tubular main body open at its upper end and having a drive shaft opening in its sidewall near the lower end thereof, a shaft supporting a spiral gear journalled in said main body with the shaft end projecting through the sidewall of said main body, bracket means projecting from said main body securable to the engine beyond the periphery of the camshaft cover plate with said shaft end positioned to extend through said cover plate and to be coupled to the adjacent end of the engine camshaft, and the driven gear of the engine distributor being insertable into the upper end of said tubular main body and into mesh with said spiral gear.

2. That improvement defined in claim 1 characterized in that said bracket means for securing said main body to an engine includes flow passageway means therethrough adapted to be connected to and form part of the engine cooling medium passage.

3. That improvement defined in claim 2 characterized in that said bracket means for securing said main body to an engine is constructed and arranged to be sandwiched between the engine block and the engine water pump with said passageway means forming a part of the cooling medium flow path through the engine and the engine water pump.

4. That improvement defined in claim 3 characterized in that said bracket means includes a pair of bracket arms extending generally in opposite directions from said main body each having a cooling medium flow passage therethrough adapted to be connected to and to form part of the cooling medium circuit of an engine when said converter kit is assembled thereto.

5. That improvement for an internal combustion engine of the type manufactured with the front end of its camshaft driven from the front end of the crankshaft and its rear end connected to drive the distributor, said improvement comprising: a main body for operatively supporting the distributor for drive from the front end of the camshaft and having a pair of passages at right angles to one another and open at one end of each passage, a spiral gear and drive shaft therefor journalled in one of said passages which drive shaft is adapted to extend through an opening formed through the engine camshaft cover plate from the exterior side thereof and to be coupled to the adjacent end of the camshaft, the second one of said tubular passages being adapted to receive the shaft and drive gear of the distributor after being dismounted from the rear end of said camshaft, and said main body including means for securing the same on the front end of the engine independently of and exteriorly of the camshaft cover plate.

6. That improvement defined in claim 5 characterized in that said main body mounting means includes a pair of brackets projecting in opposite directions from said body and having tubular passages at the outer ends thereof sized and shaped for clamping to the engine block with the tubular passages in registry with the liquid cooling medium passages at the front end of the engine.

7. That improvement defined in claim 5 characterized in that the outer end of said tubular passages of said main body include means effective to surround and form a fluid seal about the opening formed in said camshaft cover plate to accommodate the drive shaft of said spiral gear.

8. That improvement dfined in claim 6 characterized in that the ends of the flow passage of a stock engine cooling pump are securable in registry with the outer ends of said tubular pads by fasteners passing through said pads and into the engine block.

9. That improvement defined in claim 8 includes a crankshaft spacer and a set of cap screws, said spacer being installable between the engine crankshaft dampener and a drive pulley for the cooling pump using said set of cap screws thereby to support said drive pulley coplanar with the drive pulley of said stock cooling pump.

10. A converter kit for use in driving an OEM engine distributor from the front rather than the rear end of the engine camshaft, said kit comprising: a cross-shaped hollow casting adapted to be sandwiched between the engine cooling pump and the front end of the engine block, said casting having a tubular stem open at its upper end and a cross arm the outer ends of which are each provided with a passageway therethrough alignable with and connectable between a respective flow passage of the engine cooling pump and the associated cooling passage at the front end of the engine block, a first set of cap screws for holding said pump and said casting rigidly clamped to the engine, the lower end of said tubular stem having a spiral gear mounted on a drive shaft the outer end of which projects through the side-wall of said casting and is adapted to extend through a stock camshaft cover plate and to be coupled to the front end of the camshaft, and the engine distributor being mountable vertically within said tubular stem with its drive gear in mesh with said spiral gear.

11. A converter kit as defined in claim 10 characterized in the provision of a spacer having a plurality of parallel bores therethrough adapted to be installed beneath the belt pulley customarily mounted on the front end of the engine crankshaft to drive the engine cooling pump, said spacer being sized to support the belt pulley in planar alignment with the cooling pump drive pulley, and a second set of cap screws suitably sized for use in mounting said kit components on the front end of the engine forwardly of the camshaft cover plate.

12. A converter kit as defined in claim 10 characterized in that said opening in the sidewall of said casting includes sealing gasket means adapted to have sealing engagement with the exterior of a stock camshaft cover plate when said casting is clamped over the cooling passages at the front end of the engine by said first set of cap screws.

13. A converter kit as defined in claim 10 characterized in the provision of means securable to the front end of the engine camshaft and having a non-circular opening aligned with the axis of the camshaft, and the outer end of the shaft of said spiral gear being shaped to extend into and mate with said non-circular opening.

14. A converter kit as defined in claim 13 characterized in the provision of removable closure means for said passageways through the outer ends of the cross arm of said cross-shaped casting, said closure means being removable when said first set of cap screws are to be used to hold both said casting and said engine cooling pump assembled to an engine to permit use of the cooling pump to circulate the engine cooling fluid.

15. A converter kit for use in converting an engine to drive the distributor from the driven end of the engine camshaft after being manufactured with the distributor at the non-driven end of the camshaft, said kit comprising: a support bracket for a distributor, a pair of mating spiral gears assembled to and journalled in said bracket on respective shafts at right angles to one another including a distributor drive shaft having an end projecting from the sidewall of said bracket and adpated to be coupled to the front end of the engine camshaft through the camshaft cover plate, means for rigidly securing said support bracket to the front end of the engine block exteriorly of the camshaft cover plate using the threaded fastener openings employed to hold the engine cooling pump assembled to the engine cooling passages, and said distributor drive shaft being adapted to extend through an opening formed for said distributor drive shaft in a stock camshaft cover plate.

16. A converter kit as defined in claim 15 characterized in the provision of marking means adapted to be socketed centrally of the driven camshaft driving member and having a pointed outer end in aligment with the axis of the engine camshaft, the pointed end of said marking means being usable to mark the inner surface of the camshaft cover plate with the center point of a hole to be drilled through said cover plate to accommodate said distributor cover plate.

17. A converter kit as defined in claim 16 characterized in that said marking means comprises a short drill bit sized to drill a hole through said camshaft cover plate of the proper size to accommodate said distributor drive shaft.

18. A converter kit as defined in claim 15 characterized in the provision of a gear drive accessory adapted to be assebled into the engine housing originally supporting the distributor accessory having a spiral gear at the lower end thereof and operable in lieu thereof to provide a drive connection between the engine crankshaft and the engine oil pump.

* * * * *